US006882093B2

(12) United States Patent
Yamagishi

(10) Patent No.: US 6,882,093 B2
(45) Date of Patent: Apr. 19, 2005

(54) LONG-LIFE ELECTRON TUBE DEVICE, ELECTRON TUBE CATHODE, AND MANUFACTURING METHOD FOR THE ELECTRON TUBE DEVICE

(75) Inventor: Mika Yamagishi, Takatsuki (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 10/208,320

(22) Filed: Jul. 30, 2002

(65) Prior Publication Data

US 2003/0025430 A1 Feb. 6, 2003

(30) Foreign Application Priority Data

Aug. 1, 2001 (JP) ..... 2001-233241

(51) Int. Cl.[7] ..... H01J 1/14

(52) U.S. Cl. ..... 313/311; 313/310; 313/346 R; 313/341; 313/345; 313/346 DC

(58) Field of Search ..... 313/341, 345, 313/346 R, 346 DC, 309–311

(56) References Cited

U.S. PATENT DOCUMENTS 2,895,854 A 7/1959 LaRocque ..... 445/52
2002/0074921 A1 * 6/2002 Gaertner et al. ..... 313/346 R

FOREIGN PATENT DOCUMENTS

EP 0 841 676 5/1998
EP 1 039 503 9/2000

OTHER PUBLICATIONS

Proceedings of "IDW'00", Nov. 30, 2000, pp. 517–520.

* cited by examiner

*Primary Examiner*—Nimeshkumar D. Patel
*Assistant Examiner*—Sharlene Leurig

(57) ABSTRACT

An electron tube cathode includes an emitter layer 30 whose main component is barium oxide and that includes a metal and/or a metal oxide as a dopant is formed on a base metal 20 whose main component is nickel and that includes a reducing agent such as magnesium. A mole ratio of the magnesium, barium, and the dopant is expressed as Y:1000:X. When the X and Y values in are expressed as XY coordinates, the value of X and the value of Y are within a range defined by straight lines connecting points (0.7, (0.8, 15), (3, 130), (3, 30), (2.5, 10), (2, 0.1), and 0.1).

12 Claims, 12 Drawing Sheets

LONG-LIFE ELECTRON TUBE DEVICE, ELECTRON TUBE CATHODE, AND MANUFACTURING METHOD FOR THE ELECTRON TUBE DEVICE

This application is based on Patent Application No. 2001-233241, filed in Japan, the contents of which are hereby incorporated by reference.

BACKGROUND OF THE INVENTION

1. Field of the Invention

The present invention relates to a long-life electron tube device, an electron tube cathode, and a manufacturing method for the electron tube device.

2. Description of Related Art

FIG. 1 shows an electron tube cathode used in an electron tube device of a cathode ray tube for a television or the like. The electron tube cathode is composed of a cylindrical sleeve 910, a base metal 920 that caps one end of the cylindrical sleeve 910, and a heater coil 940 provided inside the cylindrical sleeve 910. The base metal 920 has nickel as the main component and includes a reducing agent such as magnesium. Furthermore, an emitter layer 930 is emitter layer 930 is formed on the base metal 920. The main component of the emitter layer 930 is an alkaline earth metal oxide such as barium oxide.

After applying an electron-emissive material suspension whose main component is barium carbonate or the like as a precursor for barium oxide or the like on the base metal 920, an assembled cathode ray tube is subjected to a exhausting process in which the cathode is heated by the heater 940 to form an alkaline earth metal oxide from the suspension. The alkaline earth metal oxide is partially reduced so as to be activated to be semiconductive. Thus the emitter layer 930 is formed.

It is necessary for electron emission from an electron tube cathode to be stable over a long period of time in order to lengthen the life of the electron tube device. However, when the base metal 920 includes magnesium and the main component of the emitter layer 930 is barium oxide or the like, emission of electrons from the cathode is accompanied by formation of a composite oxide layer (hereinafter "intermediate layer") composed of magnesium oxide or the like at the interface between the emitter layer 930 and the base metal 920. In addition to being highly resistant and therefore impeding the flow of current, this intermediate layer hinders diffusion of magnesium in the base metal 920 to the emitter layer 930, meaning that barium is not sufficiently produced in the emitter layer 930. This gives rise to a problem that emission characteristics that are stable over a long period of time cannot be obtained.

There are numerous studies in the prior art that attempt to solve the above-described problem by determining what kind of materials to use in the emitter layer 930. An example of such prior art is U.S. Pat. No. 5,146,131 which discloses a technique for adding 0.2 to 25 weight percent of europium oxide, ytterbium oxide, or lutetium oxide to the emitter layer.

However, development of an electron tube cathode with stable emission characteristics over an even longer period of time to lengthen the life of an electron tube apparatus is a perpetual problem.

SUMMARY OF THE INVENTION

The object of the present invention is to provide an electron tube device that has a longer life than a conventional electron tube device, an electron tube cathode that has stable emission characteristics over a long period of time, and a manufacturing method for the electron tube device.

The stated object is achieved by an electron tube device that includes an electron gun that includes a cathode that emits electrons, the cathode including: a base metal whose main component is nickel and that includes magnesium as a reducing agent; an emitter layer whose main component is barium oxide, and that includes a predetermined metal and/or metal oxide as a dopant; and a heater that heats the base metal and the emitter layer, wherein a ratio between (i) a number of moles of the magnesium, (ii) a number of moles of barium, and (iii) a number of moles of the predetermined metal and/or metal oxide is expressed as Y:1000:X, and when a value of Y and a value of X are expressed as XY coordinates in which the X coordinate is the value of X and the Y coordinate is the value of Y, the value of X and the value of Y are within a range defined by straight lines connecting points (0.7, 6), (0.8, 15), (3, 130), (3, 30), (2.5, 10), (2, 0.1), and (1, 0.1).

Studies undertaken by the inventor of the present invention make clear that the present invention lengthens the life of an electron tube device by approximately 20% compared to a conventional electron tube device.

BRIEF DESCRIPTION OF THE DRAWINGS

These and other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

The following describes embodiments of the present invention with reference to the drawings.

Figure 1:
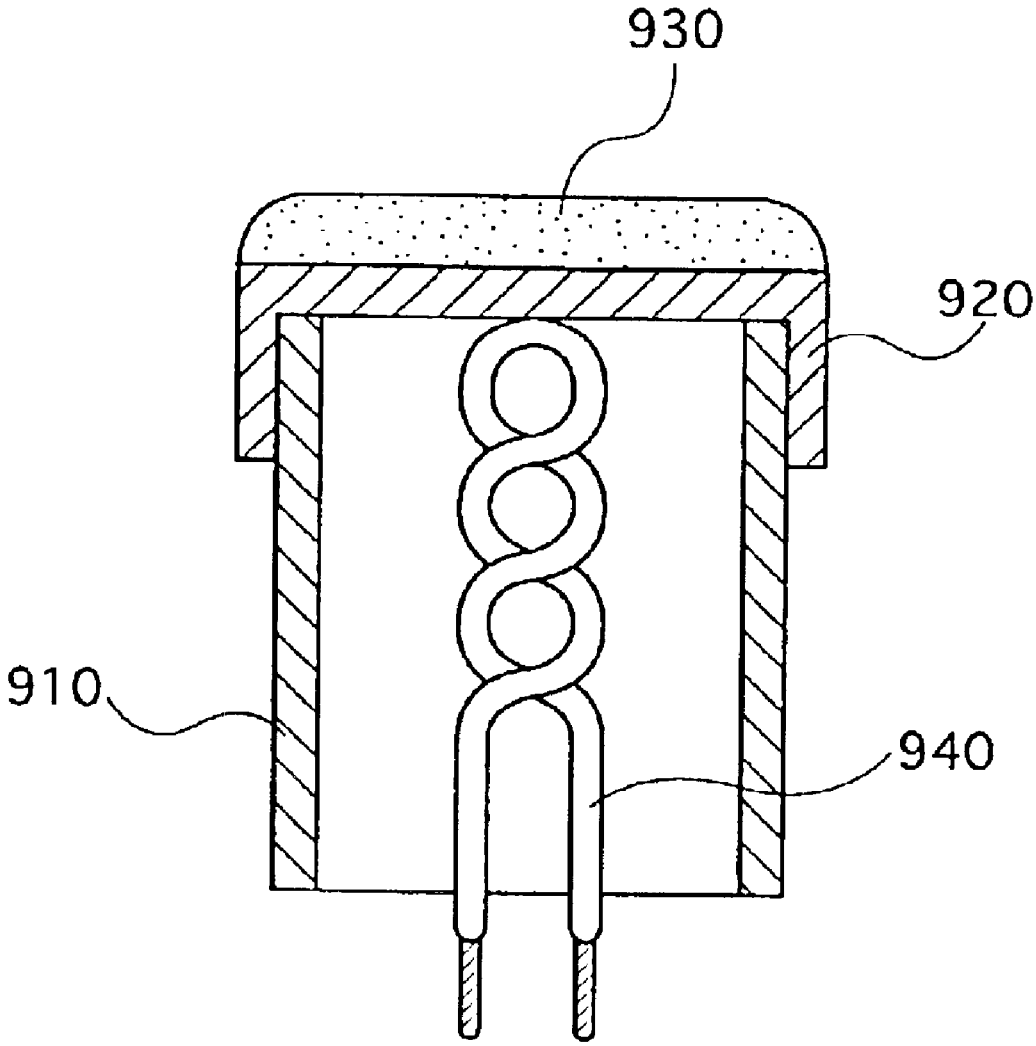
FIG. 1 is a diagrammatic cross section showing the structure of an electron tube cathode.
Figure 2:
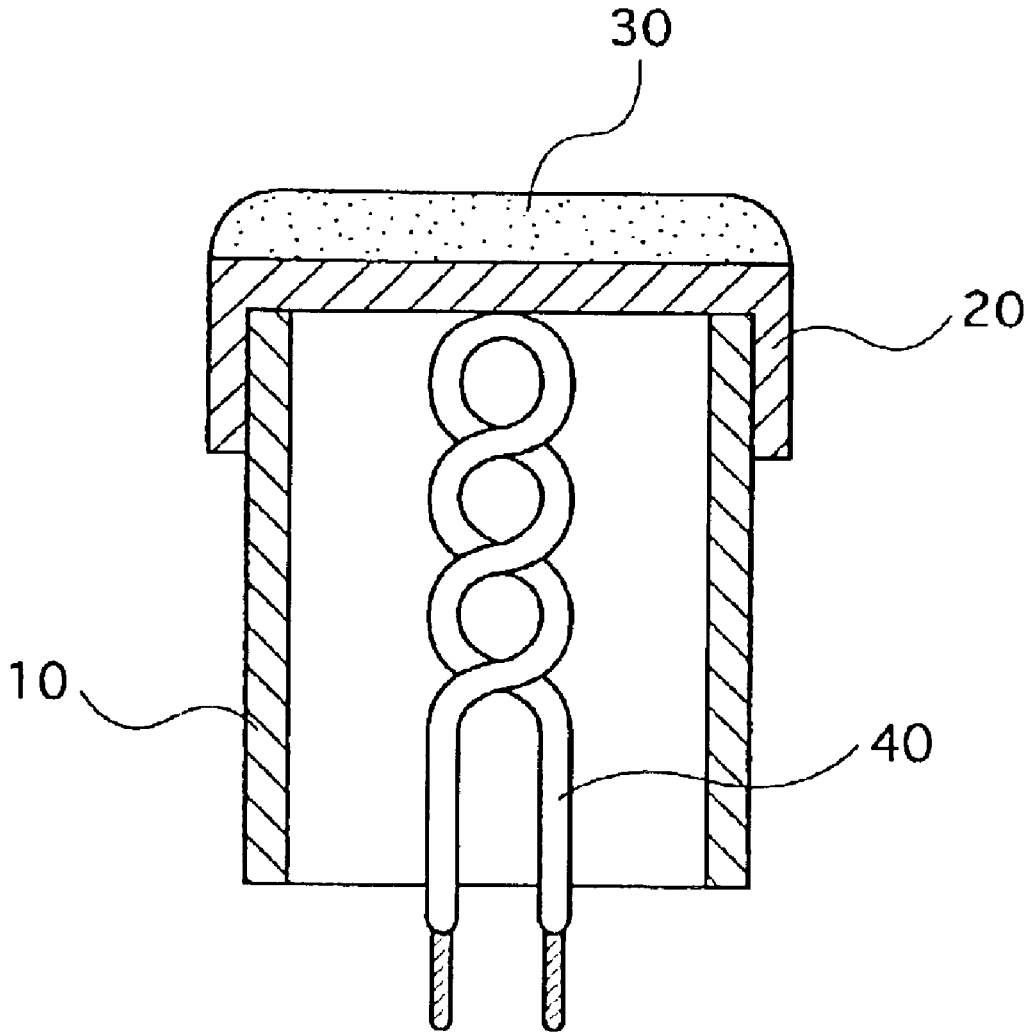
FIG. 2 is a cross section for describing the structure of the electron tube cathode of the present invention.

FIG. 2 is a schematic cross section for describing the structure of the electron tube cathode (hereinafter referred to simply as "cathode") of the present embodiment. The cathode is composed of a cylindrical sleeve 10, a base metal 20 that caps one end of the cylindrical sleeve 10, and a heater coil 40 provided inside the cylindrical sleeve 10. The base metal 20 has nickel as the main component and includes a predetermined molarity (%) of magnesium as a reducing agent. Note that in the present embodiment, the base metal 20 is cut out in a predetermined size from a 100 $\mu$m thick nickel plate that includes the predetermined molarity of magnesium. An emitter layer 30 is formed on the base metal 20. The emitter layer 30 has main components barium oxide and strontium oxide, and, in order to achieve stable emission characteristics over a long period of time, includes a predetermined metal and/or oxide of the metal as a dopant. The emitter layer 30 is formed by applying a suspension whose main component is an alkaline earth metal carbonate such as barium carbonate or strontium carbonate to the surface of the base metal 20 as a precursor to the barium oxide or the strontium oxide, and subjecting this to a process for forming the oxide from the carbonate. The method for forming the emitter layer 30 in the present embodiment is described in detail later.

The inventor investigated ways of optimizing the reductive reaction between the reducing agent, such as magnesium, in the base metal 20 and the oxide of the alkaline earth metal in the emitter layer 30. She discovered that the reaction can be optimized to obtain stable emission characteristics over a long period of time by defining an appropriate ratio between the number of moles of the reducing agent in the base metal 20, the total number of moles of the barium oxide and the remaining barium carbonate (if any) (hereinafter "number of moles of barium") in the emitter layer 30, and the number of moles of the dopant.

More specifically, when the ratio between the number of moles of the magnesium in the base metal 20, the number of moles of barium in the emitter layer 30, and the number of moles of the dopant in the emitter layer 30 is expressed as Y:1000:X, and the values of X and Y are expressed as XY coordinates in which the X coordinate is the value of X and the Y coordinate is the value of Y, the inventors discovered that stable emission characteristics could be obtained over a long period of time if the values of X and Y are in a range defined by straight lines connecting points (0.7, 6), (0.8, 15), (3, 130), (3,30), (2.5, 10), (2,0.1), and (1, 0.1). Note that although the number of moles of the magnesium may vary depending on the thickness of the metal plate used for the base metal 20, when thickness is within a range ordinarily used for the base metal 20 (approximately 80 to 150 $\mu$m) no substantial difference is found in characteristics if the number of moles is prescribed within the above-described range.

Figure 3:
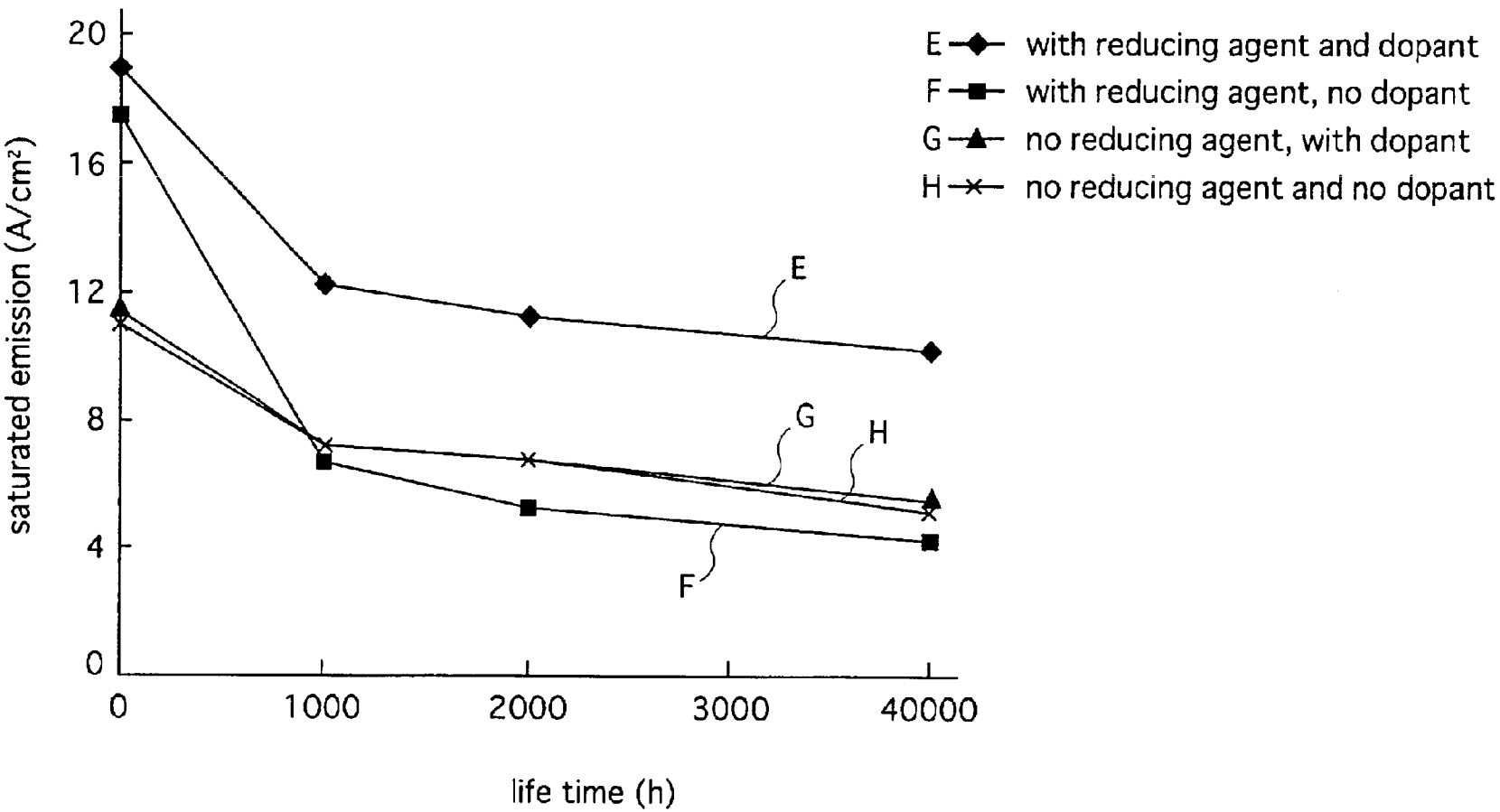
FIG. 3 shows the relationship between life time and saturated emission for combinations of the base metal including a reducing agent and not including a reducing agent and the emitter layer including a dopant and not including a dopant.
Figure 4:
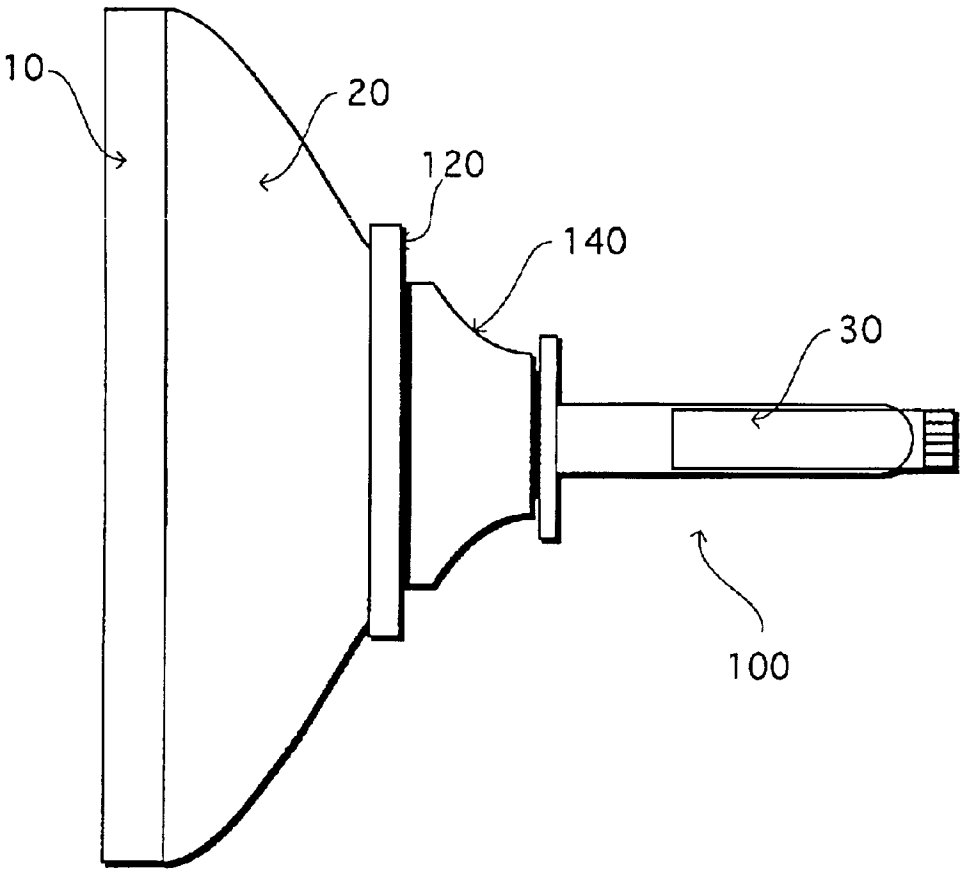
FIG. 4 shows the structure of a cathode ray tube as one example of an electron tube device that uses the electron tube cathode of the present invention.

FIG. 3 shows the relationship between life time and saturated emission current (A/cm$^2$) for combinations of the base metal 20 including a reducing agent and not including a reducing agent and the emitter layer 30 including a dopant and not including a dopant. The examples shown in the figure were evaluated on initial operation and every 1000 hours thereafter according to the following method. In the measurement of saturated emission current, the cathode in the electron gun 30 in the cathode ray tube device 100, as shown in one example in FIG. 4, was operated at a temperature of, for example, 820° C., and a sufficiently high voltage pulse (one shot of a pulse of 3 $\mu$s in width) was applied to the anode (G1 and G2 in common). The cathode current at that point was considered to be the saturation emission, the value of which was read on an oscilloscope.

In FIG. 3, a line E shows characteristics of the cathode when the base metal 20 includes a reducing agent and the emitter layer 30 includes a metal (or metal oxide) dopant. A line F shows characteristics of the cathode when the base metal 20 includes a reducing agent but the emitter layer 30 does not include a dopant. A line G shows the characteristics of the cathode when the base metal 20 does not include a reducing agent but the emitter layer 30 includes a dopant. A line H shows the characteristics of the cathode when the base metal 20 does not include a reducing agent and the emitter layer 30 does not include a dopant.

Compared to the lines F, G, and H, the line E shows high saturated emission current, and shows that stable emission characteristics are obtained over a long period of time. This is attributed to the metal (or metal oxide) dopant partially reacting with the reducing agent if the base metal 20 includes a reducing agent, resulting in the electric resistance of the emitter layer 30 being lowered, as well as promoting increased emission by forming a donor level.

The following describes the cathode manufacturing method of the present invention.

The mole ratio of the constituent ingredients of the cathode is specified to be within a range as described earlier. In other words, when the mole ratio of the magnesium included in the base metal 20, the barium included in the emitter layer 30, and the dopant included in the emitter layer 30 is expressed as Y:1000:X, and the value of Y and the value of X are expressed as XY coordinates in which the X coordinate is the X value and the Y coordinate is the Y value, the X and Y values are in a range defined by straight lines connecting points (0.7, 6), (0.8, 15), (3, 130), (3,30), (2.5, 10), (2,0.1), and (1, 0.1). The reason for this range is discussed later. The dopant may be CaO, Zr/ZrO, or Eu/$Eu_2O_3$, but is not limited to these, and may be any of various types of metals and/or metal oxides.

Next, the alkaline earth metal carbonates barium carbonate and strontium carbonate and a dopant (in the present embodiment calcium oxide) are mixed with an organic solvent composed of 85% diethyl carbonate and 15% nitric acid (volume ratio), to form a suspension for producing the emitter layer 30. Here, the mole ratio of the barium carbonate to the strontium carbonate is 1:1, or more preferably 1:1.02. The average diameter of the grains of both the alkaline earth metal carbonates and the dopant (calcium oxide in this embodiment) is 3 $\mu$m. Note that it is desirable that the temperature of the suspension be maintained at approximately 20° C. in order that the viscosity of the suspension remain constant, since a constant viscosity is the most important factor in stabilizing application characteristics.

Meanwhile, the base metal 20, which has nickel as the main component and includes a reducing agent such as magnesium, is heated using a heater or the like to 40±10° C. Next, the suspension having a temperature of approximately 20° C. is sprayed onto the base metal 20 that has been heated to 40±10° C., using a spray gun. Here, the pressure, the time and the number of sprays, are controlled so that the emitter layer 30 has a density of 0.60 to 0.75 g/cm$^3$ and a thickness of 50 to 75 $\mu$m after drying. At this stage, the base metal 20 and the emitter layer 30 are inspected visually to confirm that the emitter layer 30 adheres satisfactorily to the base metal 20 (that there are no defects at the corners).

In a cathode manufactured for comparison purposes (hereinafter "comparison cathode"), the emitter layer 30 was made to have a density of 0.60 to 0.75 g/cm$^3$ and a thickness of 50 to 75 $\mu$m, however the suspension that was sprayed on the base metal 20 was not heated to the temperature described above. The emitter layer 30 in the comparison cathode could be seen to be peeling from the base metal 20 at the corners. In contrast, when the base metal 20 heated to 40±10° C. as described above was used, the emitter layer 30 adhered strongly enough to the base metal 20 enough that almost no peeling at the corners could be seen.

Next, as described earlier, the assembled cathode ray tube is subjected to an exhausting process in which the cathode is heated by the heater 40 to form barium oxide from the barium carbonate. The barium oxide is partially reduced so as to be activated to be semiconductive. Thus the cathode of the present invention is manufactured.

The cathode manufacturing method of the present invention produces a cathode that shows satisfactory emission characteristics in practical use for forty thousand hours or longer. Specifically, a cathode can be manufactured that achieves a saturated current remaining ratio of 50% after 4000 life hours or higher or an emission remaining ratio of 40% or more after 4000 life hours in an accelerated life test. Note that the accelerated life test is conducted by elevating to 820° C. the temperature of a cathode whose rated temperature is 760° C.

Furthermore, by applying the suspension for forming the emitter layer 30 to the base metal 20 heated to 40±10° C., the adhesive strength of the emitter layer 30 can be increased. This enables manufacturing of a cathode that has favorable emission current density distribution, and also improved product yield in manufacturing.

In addition, by forming the emitter layer 30 so as to have a density of 0.60 to 0.75 g/cm$^3$ and a thickness of 50 to 75 $\mu$m, the surface coarseness of the emitter layer 30, as expressed by the highest point of the surface (JIS specification JISB0601-1982), is leveled to approximately 10 to 15 $\mu$m. This enables manufacturing of a cathode that has even more favorable electron emission current density distribution, resulting in improved product yield in manufacturing.

The following describes examples of experiments that confirm the effects of the present invention.

A plurality of types of cathodes were manufactured with the structure shown in FIG. 2. In each of the cathodes, the emitter layer 30 had a thickness of approximately 65 $\mu$m and a density of approximately 0.6 g/cm$^3$. Here, the number of moles of barium included in the emitter layer is expressed as 1000, the number of moles of calcium oxide, which is the metal oxide used as the dopant, is expressed as X, and the number of moles of magnesium included in the base metal 20 is expressed as Y. The X and Y values were varied between the cathodes. Each of the cathodes was integrated into a cathode ray tube for use in a 46 cm computer monitor, and a life test performed on the cathode. The results of the life tests are shown in FIGS. 5, 6, 7, 9, and 10.

Figure 5:
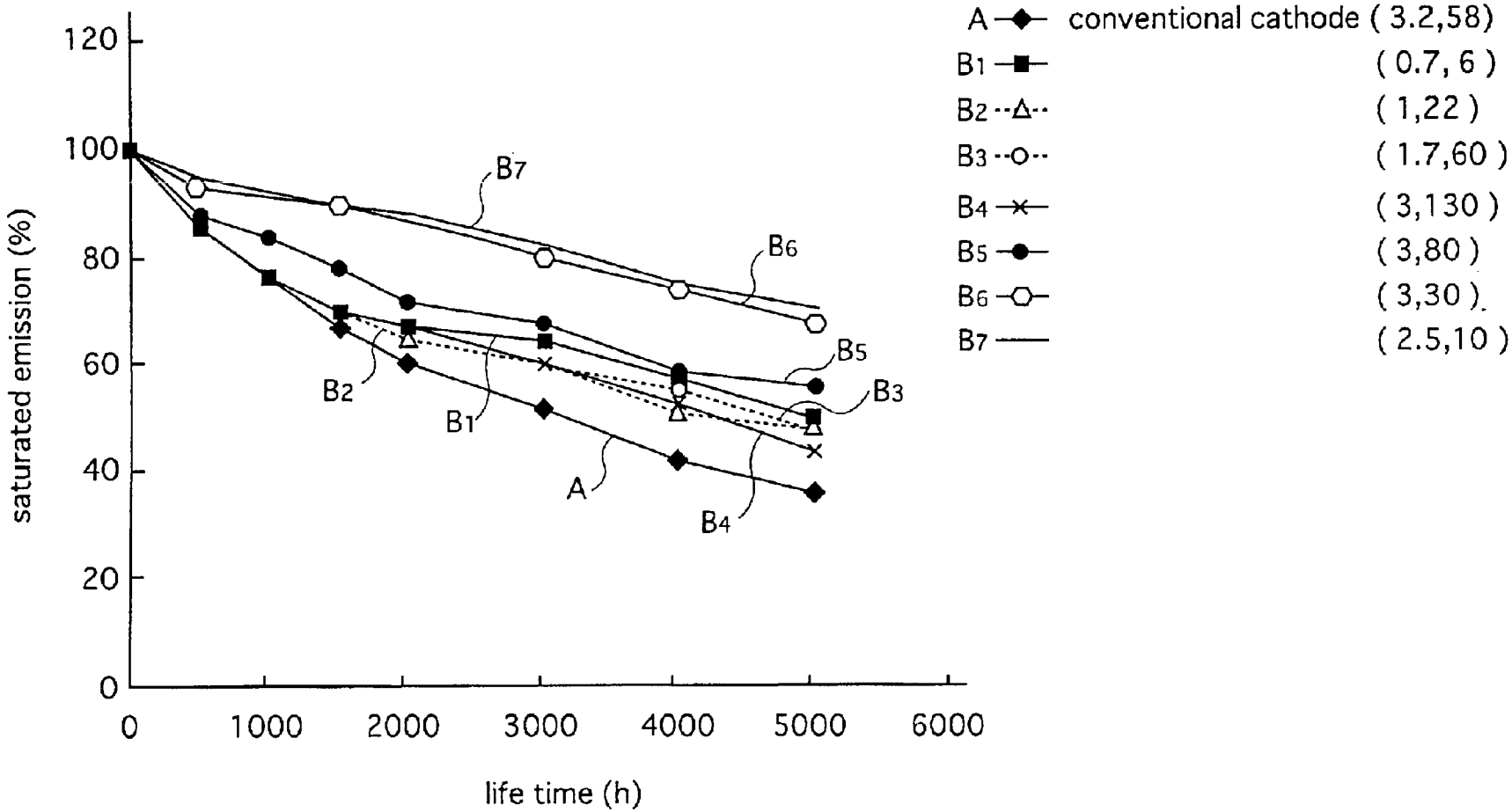
FIG. 5 shows the relationship between life time and saturated current remaining ratio for combinations of X and Y values.
Figure 6:
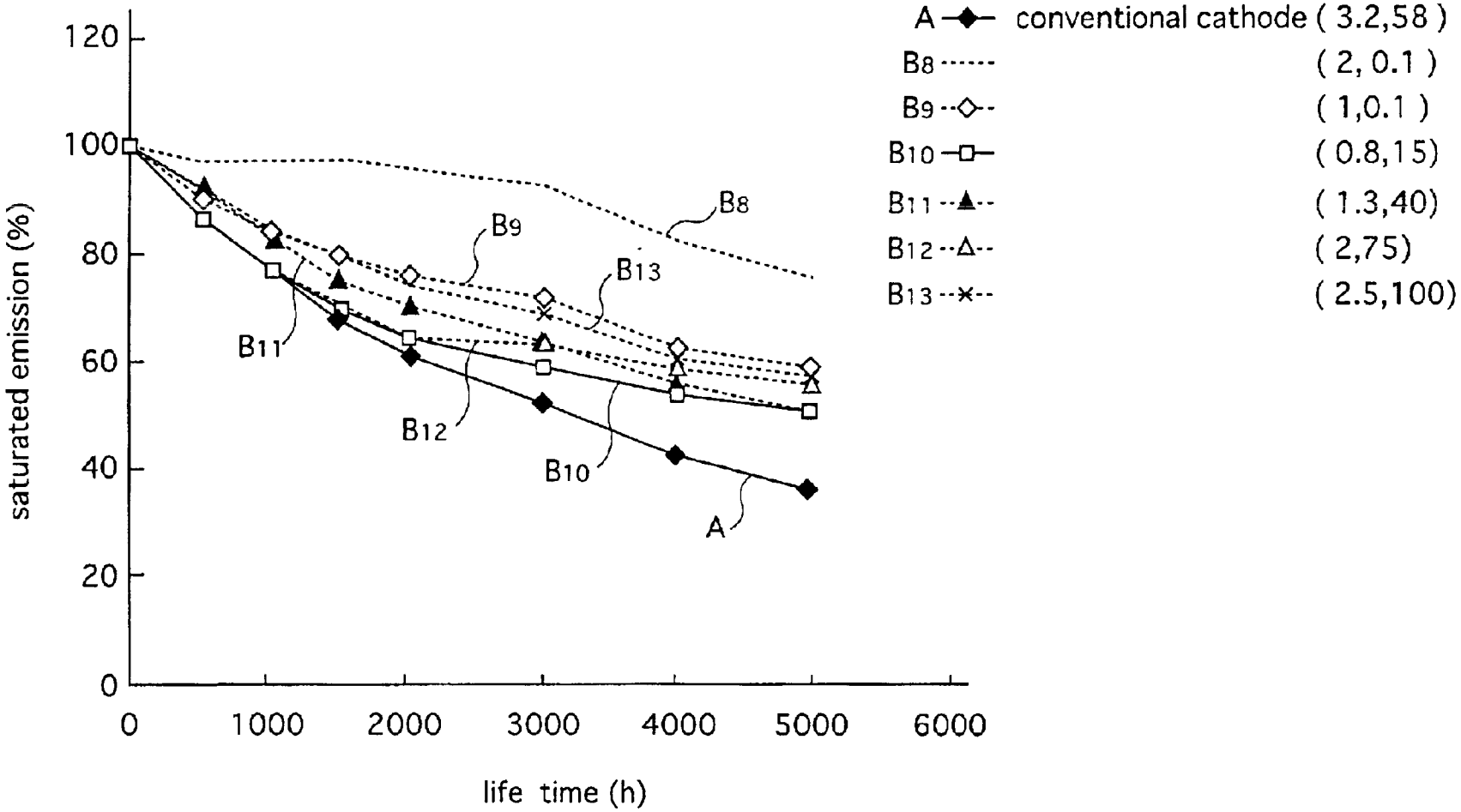
FIG. 6 shows the relationship between life time and saturated current remaining ratio for combinations of X and Y values.
Figure 7:
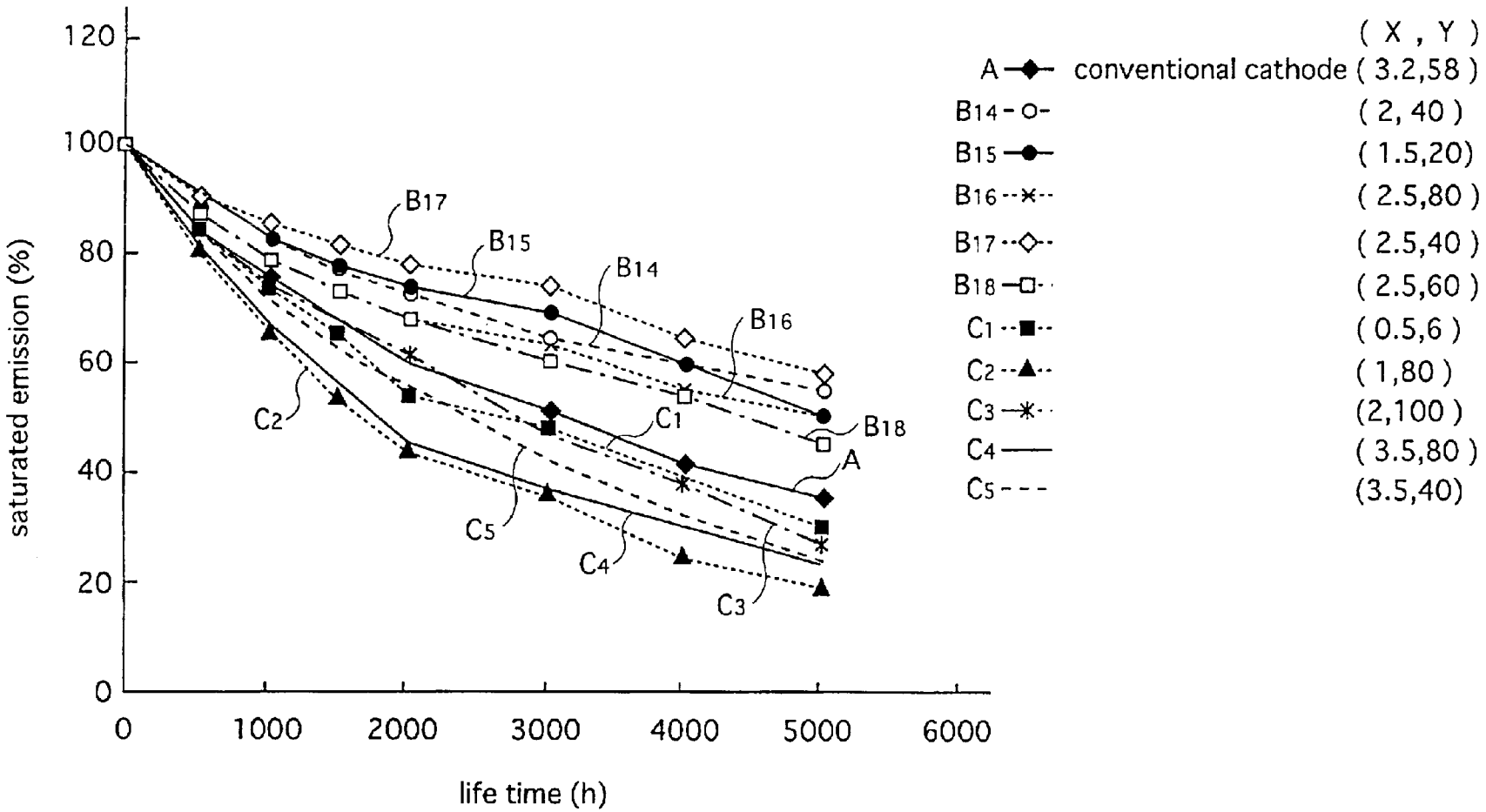
FIG. 7 shows the relationship between life time and saturated current remaining ratio for combinations of X and Y values.
Figure 9:
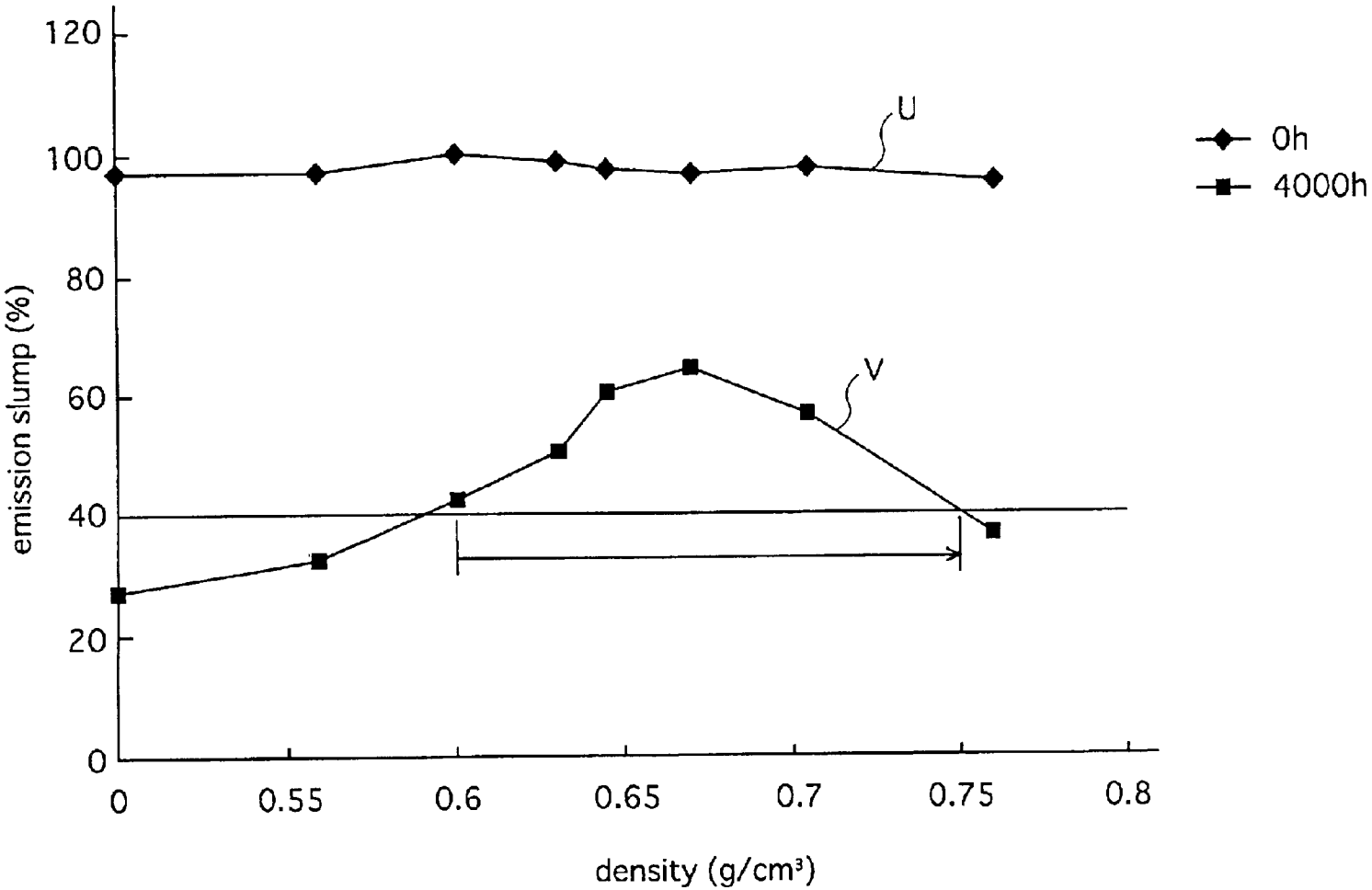
FIG. 9 shows the relationship between the density of the emitter layer and emission remaining ratio.
Figure 10:
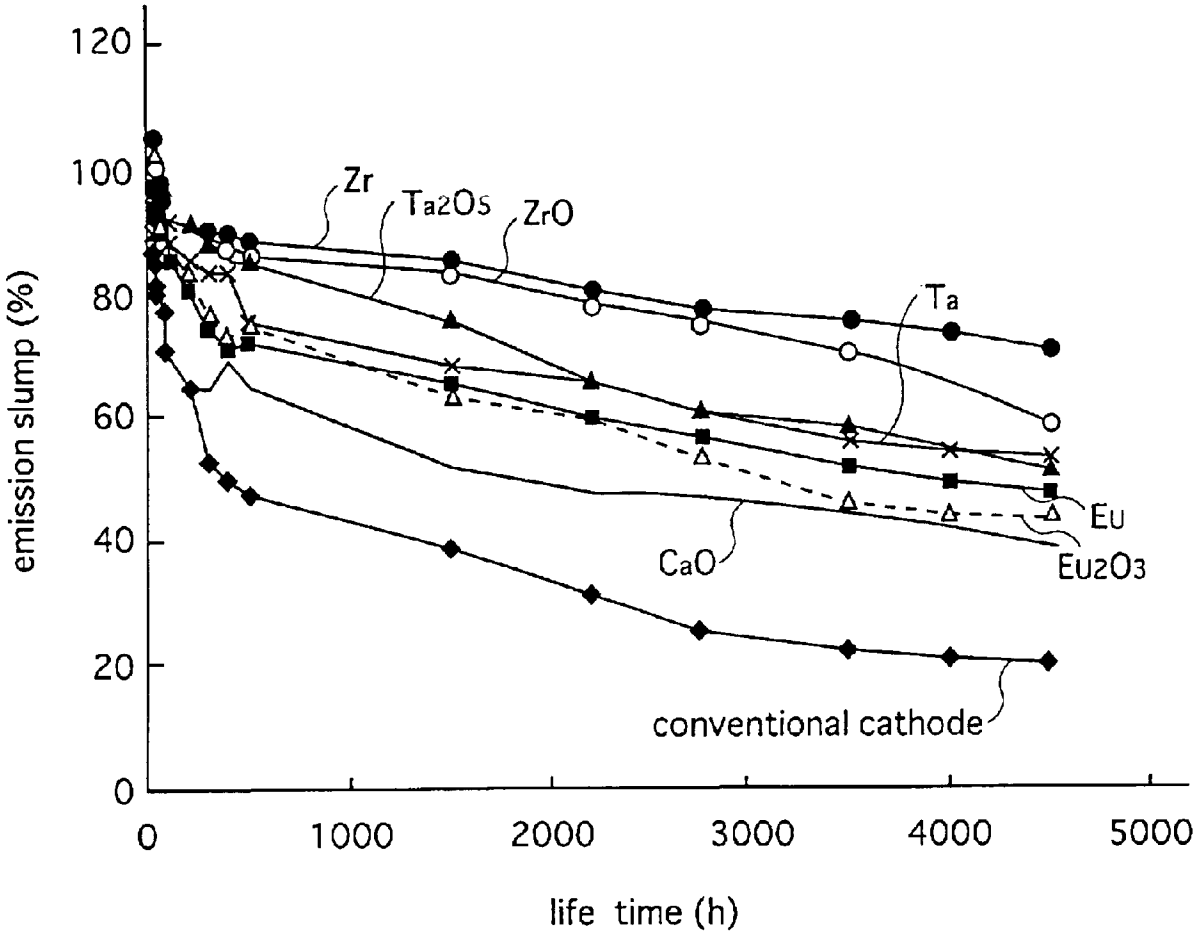
FIG. 10 shows the relationship between life time and emission remaining ratio, for various types of dopant.

Evaluation of the life of the cathodes is expressed in terms of "saturated current remaining ratio" from which the quality of the performance of the cathode can easily be judged, and "emission remaining ratio" by which the quality of the life of the cathode when actually operating can be easily judged. FIGS. 5, 6 and 7 show the saturated current remaining ratio, and FIGS. 9 and 10 show the emission remaining ratio.

Note the accelerated life test, as described earlier, is conducted by elevating to 820° C. the temperature of a cathode whose rated temperature is 760° C., and a direct current of 300 $\mu$A is obtained from the cathode. It has been confirmed that a cathode that has a saturated current remaining ratio of 50% or higher after 4000 hours of life time or that has an emission remaining ratio of 40% or higher after 4000 hours of life time is able to operate satisfactorily for up to 40,000 hours in practical usage (here satisfactory operation denotes that a cathode has stable emission characteristics over a long period of time), hence the cathodes were evaluated on this basis.

Here, "saturated current remaining ratio" is the percentage of saturated emission for each elapsed life hour relative to an initial saturated emission of 100%. "Emission remaining ratio" is the percentage of emission slump for each elapsed life hour in relation to an initial emission slump of 100%. Note that the emission remaining ratio is evaluated in the following way. A voltage is applied to a grid electrode G1 and a grid electrode G2 in a triode unit of electron gun in the cathode ray tube that face the cathode, on initial operation and each 1000 hours thereafter. A cathode current a is measured at initial life, and a cathode current P is measured after every subsequent 1000 hours of life time, to find $100\beta/\alpha$. The resulting emission remaining ratio is used to judge the quality of each cathode according to the aforementioned basis for evaluation (40% or higher). Note that in order to judge the initial emission slump, the cathode current a is measured, and then a cathode current $\gamma$ is measured five minutes later, to find $100\gamma/\alpha$ which is considered to be the initial emission slump.

As is clear from FIGS. 5, 6, and 7, after 4000 hours of life time, the saturated current remaining ratio of a conventional cathode (X=3.2, Y=58), represented by a line A, is 41%, meaning that such a cathode does not operate satisfactorily in practical use. In contrast, 18 types of cathodes of the present invention, represented by lines B1, B2, B3, B4, B5, B6, B7, B8, B9, B10, B11, B12, B13, B14, B15, B16, B17, and B18, have a saturated current remaining ratio of 50% or higher, meaning that such cathodes operate satisfactorily in practical use. However, cathodes represented by lines C1, C2, C3, C4, and C5 have a saturated current remaining ratio of 40% or less, meaning that such cathodes do not operate satisfactorily in practical use.

Figure 8:
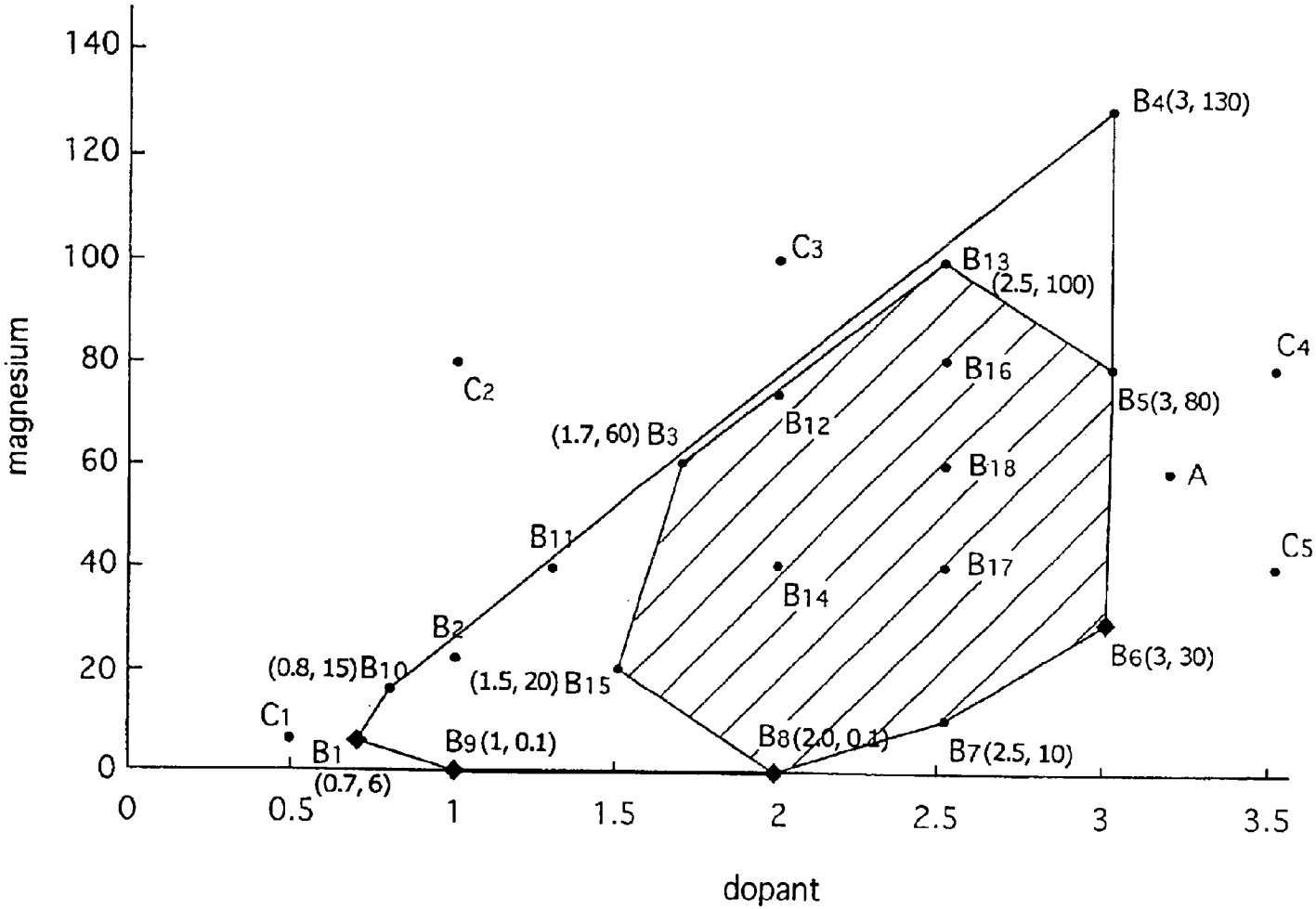
FIG. 8 shows an appropriate range for the mole ratio of magnesium in the base metal and a dopant (CaO) in the emitter layer.

In FIG. 8 points that fall in a range defined by lines show the 18 types of cathodes represented by the lines B1 to B18 in FIGS. 5 to 7. In XY coordinates, the mole ratio X of the calcium oxide as dopant, which is a metal oxide, is expressed by the X coordinate, and the mole ratio Y of magnesium is expressed by the Y coordinate. The X and Y values of the 18 points are within a range defined by straight lines connecting points (0.7, 6), (0.8, 15), (3, 130), (3, 30), (2.5, 10), (2, 0.1), and (1, 0.1). These results clearly demonstrate that it is preferable that the amount of magnesium is not too great in relation to the amount of dopant (C2, C3), and that it is also preferable that the amount of dopant is not too great in relation to the amount of magnesium (C4, C5).

Note that in FIG. 8 the range shaded by the diagonal lines, in other words where the X and Y values are within a range defined by straight lines connecting points (1.5, 20), (1.7, 60), (2.5, 100), (3, 80), (3, 30), (2.5, 10), and (2, 0.1), is even more desirable because a saturated current remaining ratio of 60% or higher can be obtained after 4000 hours of life time in the accelerated life test in this range.

FIG. 9 shows the relationship between the density of the emitter layer 30 and the emission remaining ratio. A line U represents the emission remaining ratio at initial operation, and a line V represents the emission remaining ratio 4000 life hours thereafter. The line U shows that the density has little effect on the initial emission remaining ratio. In contrast, when the density is less than 0.6 g/cm$^3$ or more than 0.75 g/cm$^3$, the emission remaining ratio after 4000 hours is less than 40%, meaning that such cathodes do not operate satisfactorily in practical use. This is attributed to the gross weight of the BaO in the emitter layer 30 being low when the density is less than 0.6 g/cm$^3$, meaning that sufficient emission cannot be supplied over a long period of time. Furthermore, since high density means that the electron emissive layer has low porosity, the heat efficiency is reduced when the density exceeds 0.75 g/cm$^3$. This also means that sufficient emission cannot be supplied over a long period of time.

Note that when the density exceeds 0.75 g/cm$^3$, 5% or more of the total weight of emitter layer 30 drops off. This high rate means that such a cathode does not operate satisfactorily in practical use.

FIG. 10 shows the relationship between life time and emission remaining ratio depending on the type of dopant included in the emitter layer 30 of the present invention. The figure shows substances other than the calcium oxide described in the test that are suitable for dopant to obtain an emission remaining ratio of 40% or higher after 4000 hours. These are metal substances europium, tantalum and zirconium, and metal oxides europium oxide, tantalum oxide and zirconium oxide. A higher emission remaining ratio after 4000 hours can be obtained with these substances than with calcium oxide. Furthermore, life tests performed on cathodes manufactured using europium, tantalum, zirconium, europium oxide, tantalum oxide or zirconium oxide as the dopant instead of calcium oxide confirm that a saturated current remaining ratio of 50% or higher after 4000 hours can be obtained in a range in which, when the mole ratio of magnesium, barium, and dopant is when expressed as Y:1000:X and the X value and the Y value are expressed as XY coordinates, is defined by straight lines connecting points (0.7, 6), (0.8, 15), (3, 130), (3, 30), (2.5, 10), (2, 0.1), and (1, 0.1). Details of results when europium/europium oxide and zirconium/zirconium oxide are used as dopant are described later.

Note that when the emitter layer 30 is thinner than 45 $\mu$m, the saturated current remaining ratio after 4000 hours of life time falls below 50%, meaning that such a cathode does not operate satisfactorily in practical use. Furthermore, when the emitter layer 30 is thicker than 80 $\mu$m, it does not adhere strongly to the base metal 20, meaning that grains easily drop off the emitter layer 30 if the cathode is subjected to impact.

In order to both lengthen the life of the emitter layer 30 and prevent grains dropping off the emitter layer 30, it is preferable that the thickness of the emitter layer 30 is in a range of at least 50 $\mu$m and no more than 75 $\mu$m.

Figure 11:
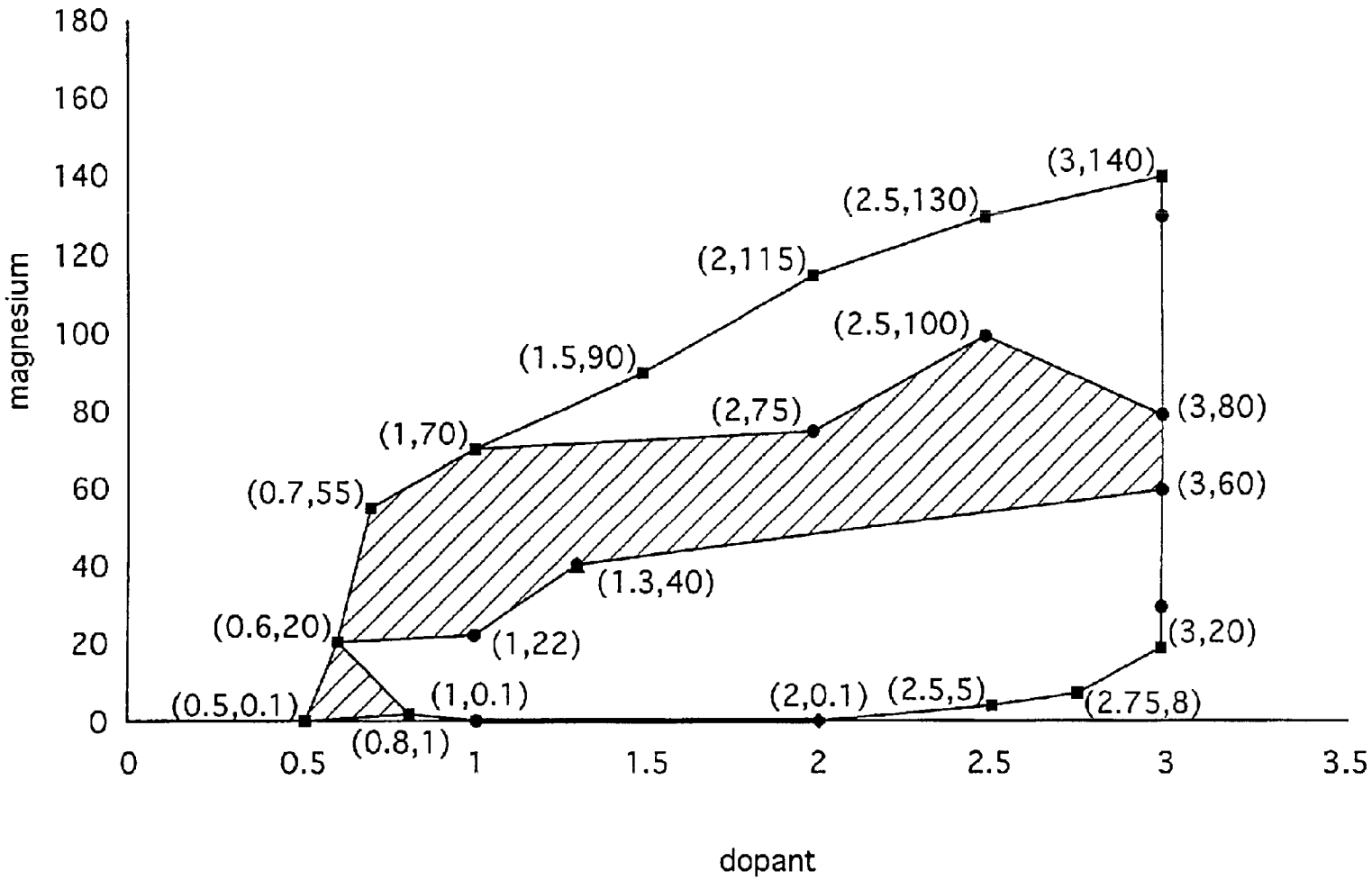
FIG. 11 shows a favorable range in which to use europium or europium oxide as dopant.
Figure 12:
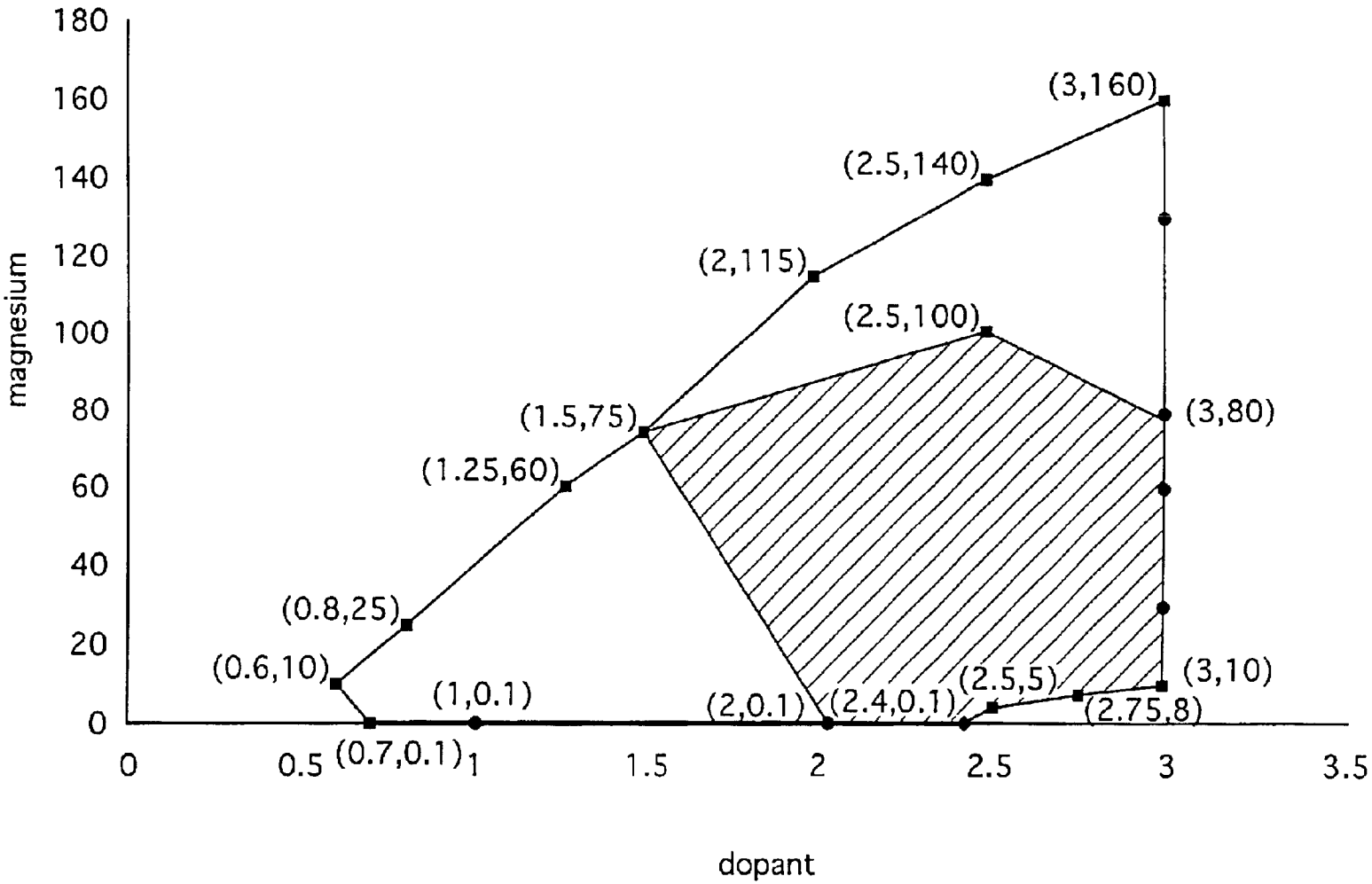
FIG. 12 shows a favorable range in which to use zirconium or zirconium oxide as dopant.

Lastly, a description is given of examples of when europium/europium oxide and zirconium/zirconium oxide are used as dopant. FIG. 11 shows examples of when europium/europium oxide is used as the dopant. FIG. 12 shows examples of when zirconium/zirconium oxide are used as the dopant.

As shown in FIG. 11, when europium or europium oxide is used as dopant, a range defined by straight lines connecting points (0.5, 0.1), (0.6, 20), (0.7, 55), (1, 70), (1.5, 90), (2, 115), (2.5, 130), (3, 140), (3, 20), (2.75, 8), (2.5, 5), (2, 0.1), (1, 0.1), and (0.8, 1) is preferable. It was confirmed that a saturated current remaining ratio of 50% or higher after 4000 hours of life time can be obtained in this range. The ranges shaded with the diagonal lines, in other words the range defined by straight lines connecting points (0.6, 20), (0.7, 55), (1, 70), (2, 75), (2.5, 100), (3, 80), (3, 60), (1.3, 40), and (1, 22), or the range defined by straight lines connecting points (0.6, 20), (0.8, 1), and (0.5, 0.1) are particularly desirable. In this range the saturated current remaining ratio was 60% or higher after 4000 hours of life time.

Furthermore, as shown in FIG. 12, when zirconium or zirconium oxide is used as dopant, a range defined by straight lines connecting points (0.6, 10), (0.8, 25), (1.25, 60), (1.5, 75), (2, 115), (2.5, 140), (3, 160), (3, 10), (2.75, 8), (2.5, 5), (2.4, 0.1), and (0.7, 0.1) is preferable. In this range the saturated current remaining ratio was 50% or higher after 4000 hours of life time. The range shaded with the diagonal lines, in other words the range defined by straight lines connecting points (1.5, 75), (2.5, 100), (3, 80), (3, 10), (2.75, 8), (2.5, 5), (2.4, 0.1), and (2, 0.1) is particularly desirable. In this range the saturated current remaining ratio was 60% or higher after 4000 hours of life time.

Note that a single metal or metal oxide may be used as the dopant, or both metal and metal oxide may be used.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An electron tube device, comprising:

an electron gun that includes a cathode that emits electrons, the cathode including:

a base metal whose main component is nickel and that includes magnesium as a reducing agent;

an emitter layer whose main component is barium oxide, and that includes a predetermined metal and/or metal oxide as a dopant; and a heater that heats the base metal and the emitter layer, wherein, if a number of moles of barium included in the emitter layer is expressed as 1000, a value obtained by multiplying a number of moles of the predetermined metal and/or metal oxide included as the dopant by a value by which the number of moles of barium was multiplied in order to be expressed as 1000 is expressed as X, a value obtained by multiplying a number of moles of the magnesium included in the base metal by the value by which the number of moles of barium was multiplied in order to be expressed as 1000 is expressed as Y, and when a value of Y and a value of X are expressed as XY coordinates in which the X coordinate is the value of X and the Y coordinate is the value of Y, the value of X and the value of Y are within a range defined by straight lines connecting points (0.7, 6), (0.8, 15), (3, 130), (3, 30), (2.5, 10), (2, 0.1), and (1, 0.1).

2. The electron tube device of claim 1, wherein the dopant includes at least one member selected from the group consisting of europium, tantalum, zirconium, europium oxide, tantalum oxide and zirconium oxide, as the predetermined metal and/or metal oxide.

3. The electron tube device of claim 1, wherein when the emitter layer does not include calcium oxide as a main component, calcium oxide is added to the emitter layer as the dopant.

4. The electron tube device of claim 3, wherein if the number of moles of barium included in the emitter layer is expressed as 1000, a value obtained by multiplying the number of moles of the predetermined metal and/or metal oxide included as the dopant by a value by which the number of moles of barium was multiplied in order to be expressed as 1000 is expressed as X, a value obtained by multiplying the number of moles of the magnesium included in the base metal by the value by which the number of moles of barium was multiplied in order to be expressed as 1000 is expressed as Y, and when the value of Y and the value of X are expressed as XY coordinates in which the X coordinate is the value of X and the Y coordinate is the value of Y, the value of X and the value of Y are within a range defined by straight lines connecting points (1.5, 20), (1.7, 60), (2.5, 100), (3, 80), (3, 30), (2.5, 10), and (2, 0.1).

5. An electron tube device, comprising:

an electron gun that includes a cathode that emits electrons, the cathode including:

a base metal whose main component is nickel and that includes magnesium as a reducing agent;

an emitter layer whose main component is barium oxide, and that includes europium and/or europium oxide as a dopant; and a heater that heats the base metal and the emitter layer, wherein if a number of moles of barium included in the emitter layer is expressed as 1000, a value obtained by multiplying a number of moles of the europium and/or europium oxide included as the dopant by a value by which the number of moles of barium was multiplied in order to be expressed as 1000 is expressed as X, a value obtained by multiplying a number of moles of the magnesium included in the base metal by the value by which the number of moles of barium was multiplied in order to be expressed as 1000 is expressed as Y, and when a value of Y and a value of X are expressed as XY coordinates in which the X coordinate is the value of X and the Y coordinate is the value of Y, the value of X and the value of Y are within a range defined by straight lines connecting points (0.5, 0.1), (0.6, 20), (0.7, 55), (1, 70), (1.5, 90), (2, 115), (2.5, 130), (3, 140), (3, 20), (2.75, 8), (2.5, 5), (2, 0.1), (1, 0.1), and (0.8, 1).

6. The electron tube device of claim 5, wherein when the value of Y and the value of X are expressed as XY coordinates in which the X coordinate is the value of X and the Y coordinate is the value of Y, the value of X and the value of Y are within a range defined by straight lines connecting points (0.6, 20), (0.7, 55), (1, 70), (2, 75), (2.5, 100), (3, 80), (3, 60), (1.3, 40), and (1, 22), or within a range defined by straight lines connecting points (0.6, 20), (0.8, 1), and (0.5, 0.1).

7. An electron tube device, comprising:

an electron gun that includes a cathode that emits electrons, the cathode including:

a base metal whose main component is nickel and that includes magnesium as a reducing agent;

an emitter layer whose main component is barium oxide, and that includes zirconium and/or zirconium oxide as a dopant; and a heater that heats the base metal and the emitter layer, wherein if a number of moles of barium included in the emitter layer is expressed as 1000, a value obtained by multiplying a number of moles of the zirconium and/or zirconium oxide included as the dopant by a value by which the number of moles of barium was multiplied in order to be expressed as 1000 is expressed as X, a value obtained by multiplying a number of moles of the magnesium included in the base metal by the value by which the number of moles of barium was multiplied in order to be expressed as 1000 is expressed as Y, and when the value of Y and the value of X are expressed as XY coordinates in which the X coordinate is the value of X and the Y coordinate is the value of Y, the value of X and the value of Y are within a range defined by straight lines connecting points (0.6, 10), (0.8, 25), (1.25, 60), (1.5, 75), (2, 115), (2.5, 140), (3, 160), (3, 10), (2.75, 8), (2.5, 5), (2.4,0.1), and, (0.7, 0.1).

8. The electron tube device of claim 7, wherein if the number of moles of barium included in the emitter layer is expressed as 1000, a value obtained by multiplying a number of moles of the zirconium and/or zirconium oxide included as the dopant by a value by which the number of moles of barium was multiplied in order to be expressed as 1000 is expressed as X, a value obtained by multiplying the number of moles of the magnesium included in the base metal by the value by which the number of moles of barium was multiplied in order to be expressed as 1000 is expressed as Y, and when the value of Y and the value of X are expressed as XY coordinates in which the X coordinate is the value of X and the Y coordinate is the value of Y, the value of X and the value of Y are within a range defined by straight lines connecting points (1.5, 75), (2.5, 100), (3, 80), (3, 10), (2.75, 8), (2.5, 5), (2.4, 0.1), and (2, 0.1).

9. The electron tube device of claim 1, wherein the emitter layer has a density in a range of 0.60 to 0.75 $g/cm^3$ inclusive and a thickness in a range of 50 to 75 $\mu m$ inclusive.

10. An electron tube cathode, comprising:

a base metal whose main component is nickel and that includes magnesium as a reducing agent;

an emitter layer whose main component is barium oxide, and that includes a predetermined metal and/or metal oxide as a dopant; and a heater that heats the base metal and the emitter layer, wherein, if a number of moles of barium included in the emitter layer is expressed as 1000, a value obtained by multiplying a number of moles of the predetermined metal and/or metal oxide included as the dopant by a value by which the number of moles of barium was multiplied in order to be expressed as 1000 is expressed as X, a value obtained by multiplying a number of moles of the magnesium included in the base metal by the value by which the number of moles of barium was multiplied in order to be expressed as 1000 is expressed as Y, and when a value of Y and a value of X are expressed as XY coordinates in which the X coordinate is the value of X and the Y coordinate is the value of Y, the value of X and the value of Y are within a range defined by straight lines connecting points (0.7, 6), (0.8, 15), (3, 130), (3, 30), (2.5, 10), (2, 0.1), and (1, 0.1).

11. The electron tube cathode of claim 10, wherein the dopant includes at least one member selected from a group consisting of europium, tantalum, zirconium, europium oxide, tantalum oxide and zirconium oxide, as the predetermined metal and/or metal oxide.

12. The electron tube cathode of claim 10, wherein when the emitter layer does not include calcium oxide as a main component, calcium oxide is added to the emitter layer as the dopant.

* * * * *